United States Patent [19]

Hunter

[11] Patent Number: 4,478,122

[45] Date of Patent: Oct. 23, 1984

[54] PUNCH HEAD FOR A PUNCH PRESS

[75] Inventor: James R. Hunter, Chadds Ford, Pa.

[73] Assignee: The Warner & Swasey Company, Cleveland, Ohio

[21] Appl. No.: 401,445

[22] Filed: Jul. 26, 1982

[51] Int. Cl.[3] ..... B26D 5/08

[52] U.S. Cl. ..... 83/549; 83/71; 83/916; 83/632; 83/475; 83/523

[58] Field of Search ..... 83/71, 405, 549, 550, 83/551, 552, 618, 916, 626, 628, 632

[56] References Cited

U.S. PATENT DOCUMENTS

| | | | |
|---|---|---|---|
| 3,603,187 | 9/1971 | Bredow | 83/71 X |
| 4,126,068 | 11/1978 | Brömer | 83/916 X |
| 4,241,631 | 12/1980 | Salvatore | 83/632 X |
| 4,272,812 | 6/1981 | Svensson | 364/475 |

FOREIGN PATENT DOCUMENTS

| | | | |
|---|---|---|---|
| 1211070 | 3/1960 | France | 83/628 |
| 0742033 | 12/1955 | United Kingdom | 83/632 |

*Primary Examiner*—Paul A. Bell
*Assistant Examiner*—Taylor J. Ross
*Attorney, Agent, or Firm*—Howard G. Massung

[57] ABSTRACT

A punch press (10) having a punching head (30) which includes a large eccentric crankshaft (42) for operating selected punches (32). The large eccentric crankshaft (42) withdraws the punch (32) into an upper tool support (92) for a relatively large portion of the crankshaft rotation. The crankshaft (42) is connected to a selected punch (32) by a suitable mechanical interposer. The upper tool support (92) is provided to hold a variety of punches (32) and is movable to bring a selected punch (32) into position for being operated by the punching head (30). A mechanism is provided for relative positioning of a workpiece and the punching head (30). Since the punch (32) is withdrawn within the upper tool support (92) for a relatively large portion of the crankshaft (42) rotation the movement of the workpiece can take place while the selected punch is moving but withdrawn within the upper tool support (92).

7 Claims, 9 Drawing Figures

PUNCH HEAD FOR A PUNCH PRESS

CROSS REFERENCE TO RELATED APPLICATION

This application is related to U.S. patent application Ser. No. 401,444 entitled "Bridge Type Punch Press" and U.S. patent application Ser. No. 401,446 entitled "Universal Sheet Metal Holder" both of which are assigned to the assignee of the present invention.

BACKGROUND OF THE INVENTION

1. Technical Field

This invention relates to metalworking and more particularly to an improved punch head for a sheet metal punch press.

2. Background Art

Slider crank punch heads have for many years been used on punching machines. U.S. Pat. No. 4,272,812 illustrates a punching machine using a slider crank mechanism which operates a punching tool.

A punch press is normally associated with a two axis sheet positioning mechanism, for relative positioning of a work sheet at an appropriate position beneath the punch head. The punch head, mounted above the punching area, is connected through a suitable interposer to operate a punch in conjunction with a die, located beneath a work sheet support table. The punching head operates a punch which is contained in an upper tool holder and is aligned with an appropriate die, contained in a lower tool holder, for punching a selected hole in the workpiece.

Typical prior art punch presses have normally been designed with sheet positioning function and the punching function placed in series. During sheet positioning a two axis, X-Y, table positioning mechanism brings a sheet into a correct position to be punched. When the sheet is stopped and in the correct position to be punched the punching function commences. When punching, the punch head motion is supplied by a crank shaft starting at top dead center and making a single revolution to punch a hole in the worksheet and repark back at top dead center. From a timing standpoint, the stroke of the punch head crankshaft is usually designed to simply be adequate to take the punch from a safe position in the upper toolholder down through the sheetmetal workpiece and back to a safe position retracted into the upper tool holder. Normally no more stroke than is necessary to move the punch through the punching zone of the material is provided. In the past the higher punching rates have normally been achieved by increasing the crankshaft speed to minimize the amount of time it takes for the crankshaft to move through the 360 degree motion associated with punching a hole.

Typically, the crankshaft rpm is far in excess of the number of hits per minute the press is rated for when cycling in an intermittent mode of a single revolution of the crankshaft by application of a clutch and brake cycle for each hole that is punched. Once the clutch is engaged almost the entire 360 degrees motion of the crankshaft results in the punch being exposed below the upper tool support into the punching zone and does not allow the table to be moved during the interval.

DISCLOSURE OF THE INVENTION

The present invention teaches a punch head for a press which utilizes a crankshaft having a relatively large eccentric to reduce the angle of crankshaft rotation during which a punch, held in a punch holder, is exposed below the upper tool support. By increasing the eccentric on the crankshaft only a small portion of the revolution of the crankshaft is needed to expose the tool for punching. During the remainder of the crankshaft cycle the punching tool is drawn into the upper tool support and the work sheet can be safely positioned. The disclosed construction increases punching productivity as well as allowing larger sheet position moves during continuous stroke nibbling.

In most prior art punch presses almost the full 360 degree motion of the crankshaft is associated with punching a hole. In the present invention the punch is not exposed from the upper tool support for a considerable portion of crankshaft rotation. By not exposing the punch from the upper tool support for a substantial portion of crankshaft rotation the sheetmetal positioning mechanism can operate while the crankshaft is still rotating. By dividing the crankshaft rotation time into two intervals, one for punching and one when the punch is withdrawn within the upper tool support and by overlapping a substantial portion of sheetmetal positioning time with the portion of crankshaft rotation time when the punch is withdrawn within the upper tool support, the amount of time necessary for punching a hole and positioning the workpiece can be reduced. By overlapping functions the total cycle time to punch one hole and move the sheet to the next coordinates is reduced and thereby through put of the press is increased.

During operation when the punch head is activated it engages a properly aligned punching tool and moves it downward towards an associated aligned die, which is positioned beneath the workpiece, for punching a hole in the workpiece. An interposer is provided for making a positive connection between the crankshaft and the punch when punching. That is the crankshaft provides a positive force for moving the punch up and down. By increasing the eccentricity of the crankshaft, which engages the punching tool, the amount of time the punching tool is in a raised position is increased. The larger eccentricity that requires a crankshaft to only turn through a lesser number of degrees to punch a hole and to get the punch back out of the punch zone thereby allows the table to be moved long before the punch has completed its 360 degree revolution movement and come back to rest. By overlapping the trailing end of the punch head cycle with worksheet motion, the number of punch strokes per minute is increased without the need to increase crankshaft speed which would put excessive additional demands on the clutch and brake elements. The increased eccentricity even permits the rotational speed of the crankshaft to be reduced significantly and still maintain a desired punch cycle time. The reduced speed further enhances the length of time the punch is in the upper tool support and lends itself more to a continuous punching or nibbling operation. Reducing the crankshaft RPM decreases the heat load on the brake which stops the crankshaft after each punching operation. Improved axial air flow for the brake is also provided to lower brake operating temperature.

For continuous stroke nibbling, where the clutch is engaged and remains engaged for a multiple number of punch strokes, the longer crankshaft eccentricity provides longer safe time with the punch drawn up into the upper tool support, which can be used for the table to move the worksheet a greater distance before the punch reappears below the upper tool support to commence the next punching cycle. The present invention allows longer sheet moves for the same number of continuous stroke hits per minute thereby lending itself naturally to an effective continuous stroke nibbling operation.

The eccentric of the crankshaft is great enough so that during continuous operation, in this embodiment, the punch is withdrawn into the upper tool holder for more than 177 degrees of crankshaft rotation. The RPM of the crankshaft is low enough so that during continuous operation the worksheet positioning system has time to move the worksheet a longer selected distance while the punch is withdrawn into the punch holder.

BRIEF DESCRIPTION OF THE DRAWINGS

For a better understanding of the invention reference may be had to the preferred embodiment exemplary of the invention shown in the accompanying drawings in which.

BEST MODE FOR CARRYING OUT THE INVENTION

Figure 1:
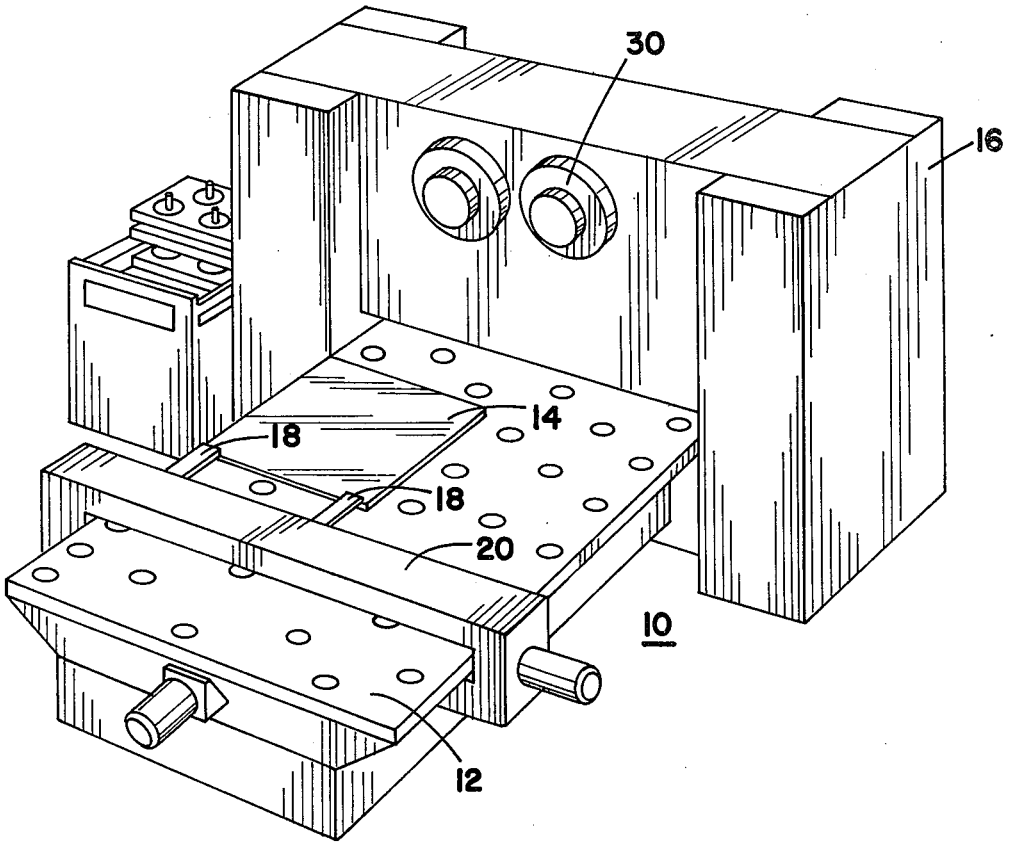
FIG. 1 is an isometric view of a punch press suitable for utilizing the improved punching head of the present invention.
Figure 2:
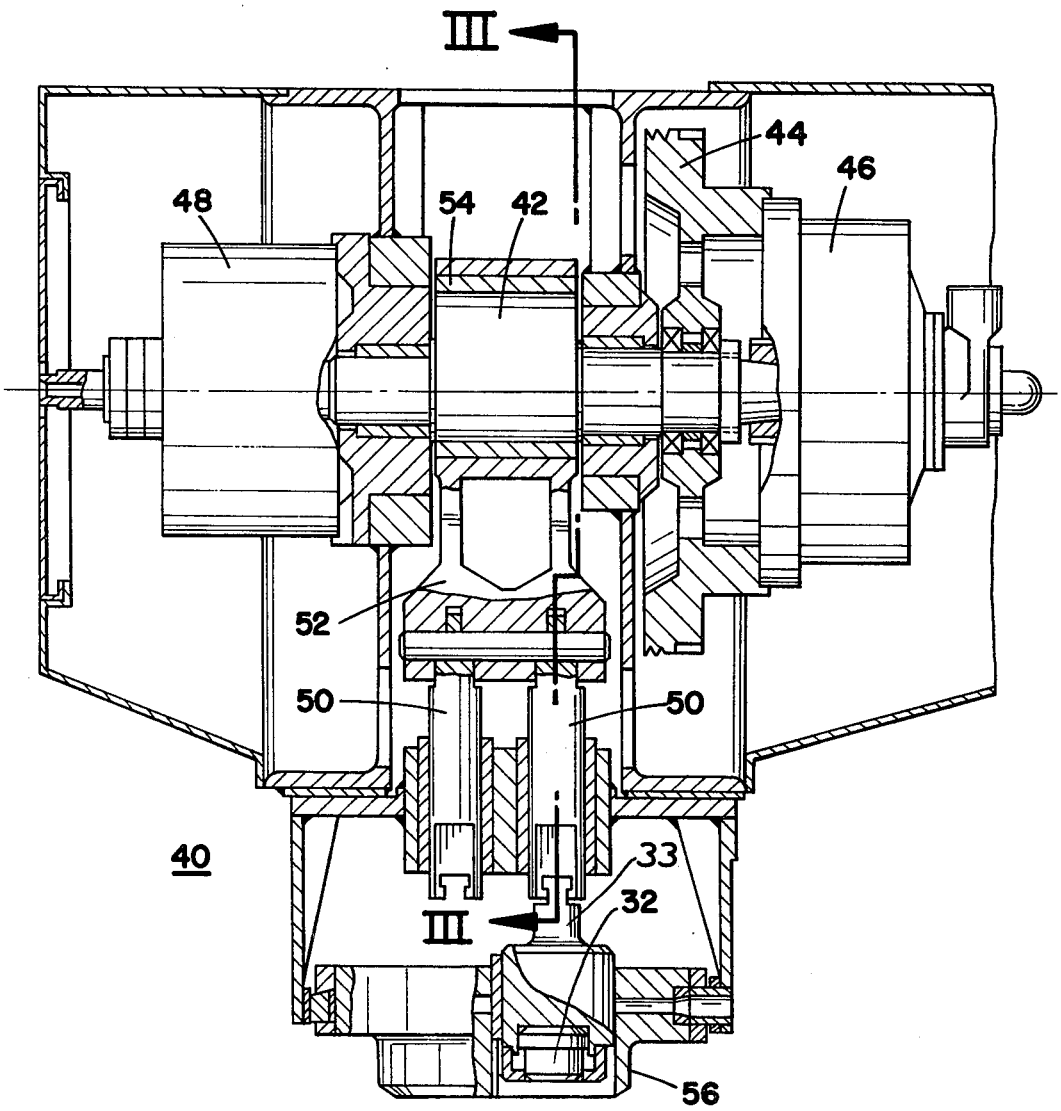
FIG. 2 is a section view through a punch head according to the present invention.
Figure 3:
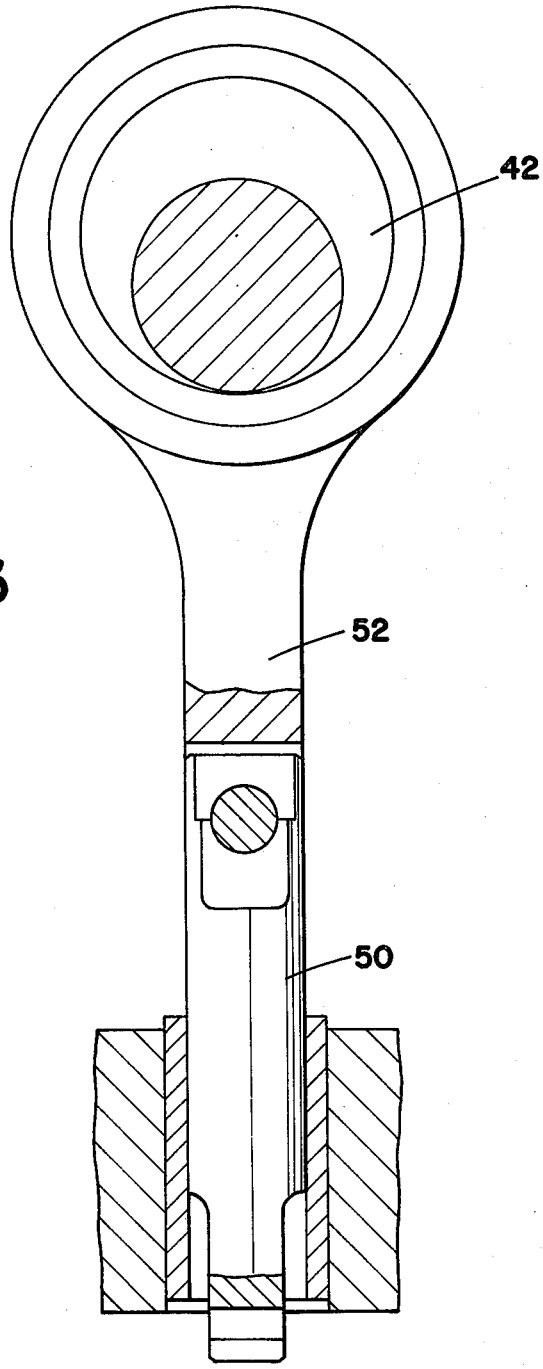
FIG. 3 is a section view taken in FIG. 2 along the lines III—III.

Refer now to the drawings and FIG. 1 in particular, there is shown a punch press 10 utilizing the teaching of the present invention. Punch press 10 includes a work table 12 on which selected worksheets 14 are positioned. Work table 12 extends to an opening through a structural frame 16 which supports a punching head 30. A carriage 20 which is movable along work table 12 is provided. A pair of sheet metal grippers 18, attached to a cross slide (not shown) that is movable along carriage 20, are provided. Sheet metal grippers 18 grip a workpiece 14 and cause it to follow the carriage and cross slide as they respond to suitable input signals for positioning worksheet 14 in proper locations beneath punch head 30. By moving the cross slide which supports work grippers 18 relative to carriage 20 and by moving carriage 20 relative to work table 12 two axes positioning of worksheet 14 is accomplished.

Figure 4:
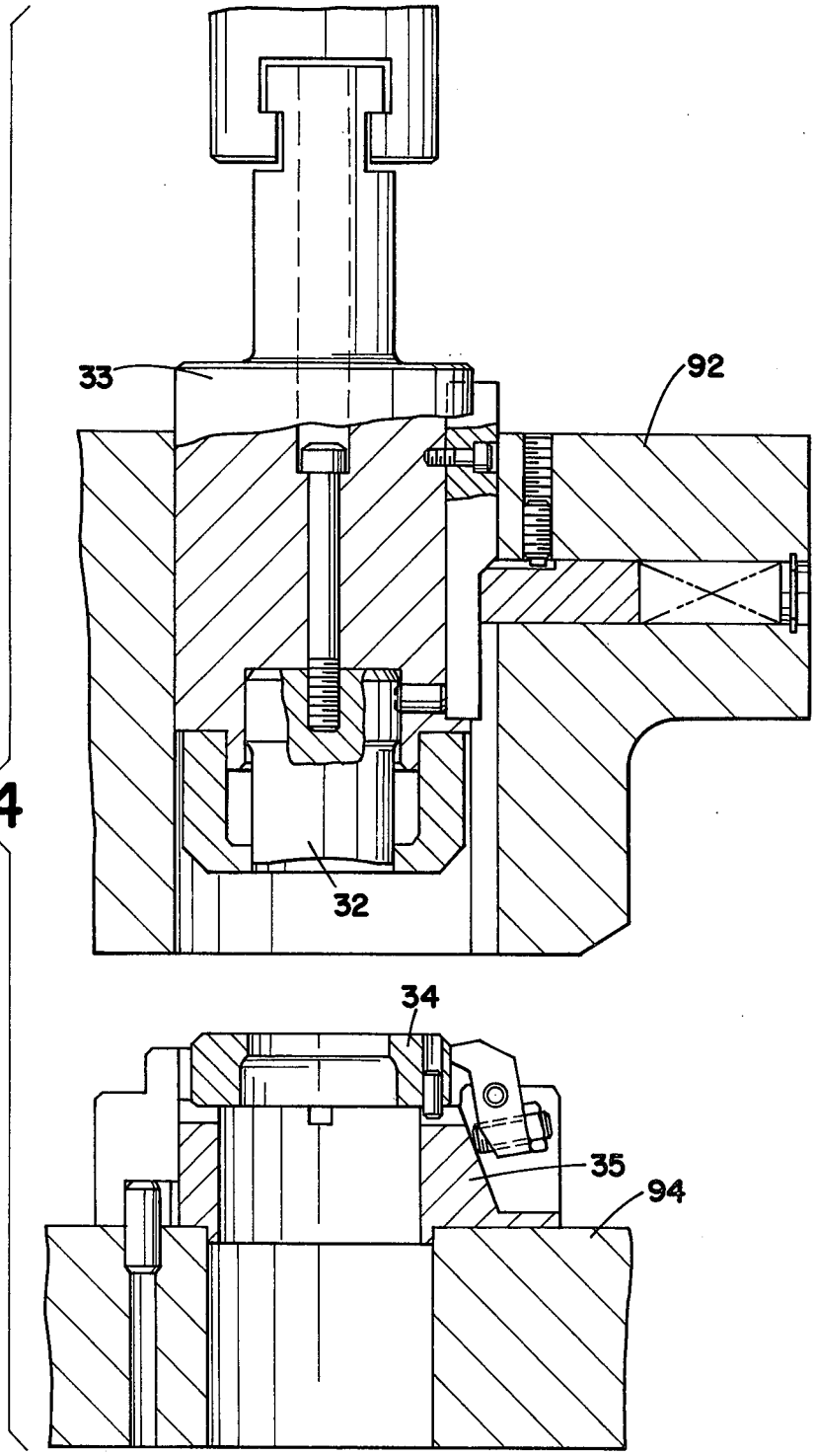
FIG. 4 is a section view of a punch and die.

As described in detail in co-pending U.S. patent application Ser. No. 401,444, entitled "A Bridge Type Punch Press" whose teachings are herein incorporated by reference, a plurality of punches 32 and dies 34 are supported by appropriate holders 33, 35 in linear cartridges 92, 94. Portions of the linear cartridges 92, 94 and a punch 32 and die 34 are shown in FIG. 4. Cartridges 92, 94 are moved to bring a selected punch 32 and its associated die 34 into position to be operated by the punching head. The punching head includes an interposer 50 having a T-shaped slot form therein. The T-shaped top on punch holder 33 is disposed within this T-shaped slot when the punch is in position to be operated. This engagement between punch holder 33 and interposer 50 ensures positive up and down movement of punch 32 during operation. The selected punch 32 is moved down into the association die through the workpiece by operation of a slider crank assembly. Crankshaft 42 which can be rotated by a suitable electric motor operates punch 32. A driven flywheel and pulley 44 is connected by a suitable clutch 46, when activated, to crankshaft 42. When clutch 46 is engaged, pulley 44, which is driven by a suitable electric motor, rotates crankshaft 42. A brake 48 is provided for stopping the crankshaft at the desired top dead center position. As crankshaft 42 is rotated about its longitudinal axis interposers 50 are raised and lowered. Interposers 50 are pinned to the pitman 52.

Pitman 52 is supported from the eccentric portion of crankshaft 42 by a bearing 54. As crankshaft 42 rotates, punch 32, which is engaged by interposer 50, is raised and lowered. The eccentricity of crankshaft 42 determines how far punch 32 will be raised and lowered and when punch 32 will be withdrawn within the upper tool cartridge 92. It is important to be sure that the punching tool is withdrawn within cartridge 92 before worksheet 14 is moved so that stripping is complete.

Normally, each time punching head 30 completes a punching cycle brake 48 dissipates a fixed amount of energy as heat in stopping the rotation of crankshaft 42. When the punching head is operating at its maximum punch rate the heat load on brake 48 is at a peak and the brake lining temperature is maximum. Exceeding the maximum punching rate increases brake lining temperature which affects braking friction and causes unacceptable variations to occur in the crankshaft stopping position.

In the disclosed punch press 10 the crankshaft RPM is reduced to lighten the heat load on brake 48. Reducing the RPM is very effective since the energy absorbed by the brake is a function of the crankshaft rotational speed squared. Axial brake air flow cooling is also provided for brake 48 and this permits an increase in punches per minute for a given punch head configuration.

Figure 8:
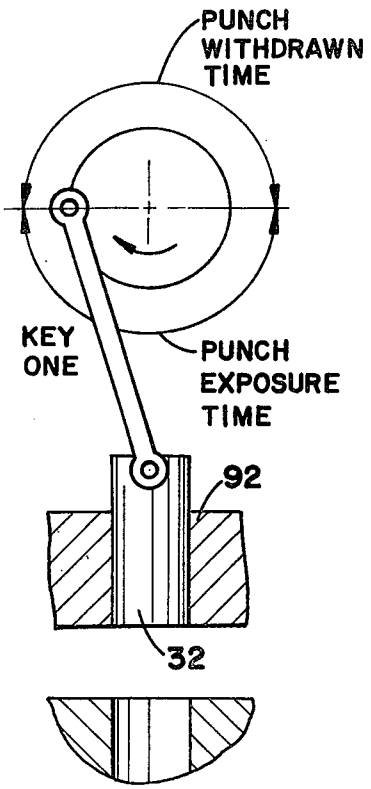
FIGS. 5 through 8 are diagramatic views of a punching head having a relatively large eccentric and therefor shorter punch exposure time.
Figure 7:
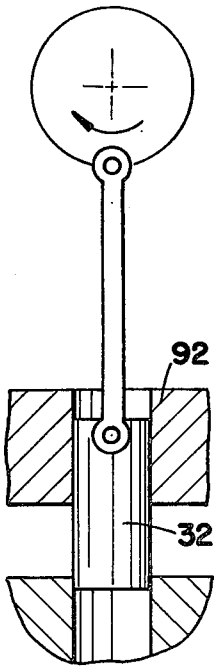
Figure 6:
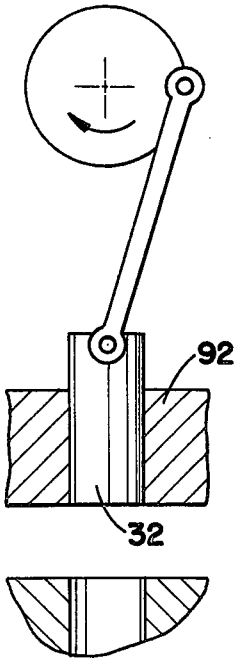
Figure 5:
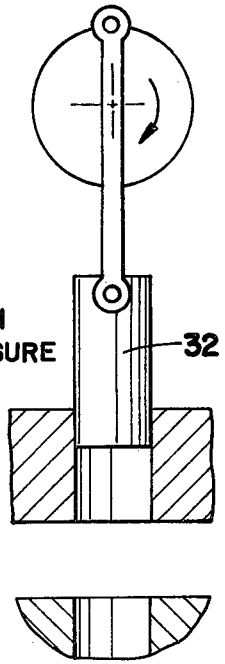
Figure 9:
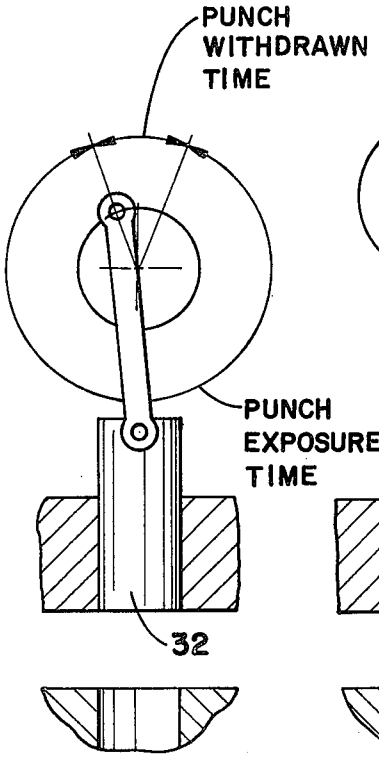
FIG. 9 (PRIOR ART)
FIG. 9 is a diagramatic view of a prior art punch showing the relatively long punch exposure time.

Referring now to FIG. 9 there is shown a diagrammatic representation of a prior art punching head. As can be seen the punch is withdrawn into the upper tool support for only a small portion of the crankshaft rotation. Higher hit rates in the prior art machines would normally be obtained by increasing the crankshaft speed. FIGS. 5 thru 8 show a diagrammatic representation of a punching head according to the present invention. In this machine a crankshaft having a substantially larger eccentric is used. This causes the punch to be withdrawn further into the upper tool holder as shown in FIG. 5. However, as shown in FIGS. 6 thru 8, the punch 32 is exposed from the upper tool support 92 for a much smaller part of each crankshaft revolution. If the crankshaft speed is maintained the same as for the prior art FIG. 9 machine the actual punch exposure time is significantly reduced. If the punch expose time is held constant the crankshaft speed can be reduced.

Prior art machines are normally designed for a minimum punch stroke; and thus, punch exposure is associated with most of each crankshaft revolution. In the press 10 the punch stroke is made longer to reduce punch exposure. This permits significant table movement time to be overlapped with crankshaft rotation.

In press 10 the crankshaft 42 speed is reduced to improve crankshaft stop position stability but the crankshaft eccentricity is increased significantly and this more than offsets the increased time to punch a hole due to decreased crankshaft speed. Diagrammatically shown in FIG. 9 is a typical small eccentric on crankshaft 42 which causes a punch exposure time of more than 300 degrees of crankshaft rotation. By increasing the eccentricity of crankshaft 42, as illustrated diagrammatically in FIGS. 5 through 8, punch exposure time is reduced to less than 183 degrees of crankshaft rotation. Even with the lower crankshaft RPM, the actual punch exposure time is less than in prior art machines. Thus, during a significant portion of crankshaft 42 rotation carriage 20 can be positioning worksheet 14. The overall result of the reduced crankshaft RPM and the increased crankshaft eccentricity is that punch press 10 operates at a lower crankshaft speed and yet produces a higher punch rate.

Nibbling has been determined to be a major contributor in heat generation in brake 48. Continuous stroke nibbling consists of engaging clutch 46 for the first punch stroke and then leaving it engaged until the last nibbling punch stroke has been performed. Clutch 46 is then disengaged and brake 48 is applied in the same fashion as during intermittent punching. Punch press 10 has a provision for continuous stroke nibbling by leaving the clutch engaged for many punch cycles and this eliminates a major heat generation problem.

Each revolution of the punch head crankshaft 42 is divided into two segments: (1) punch cycle and (2) table advancement cycle. In order to assure that the table, and gripped worksheet 14 are not in motion during the punching cycle, the table is not allowed to advance until the punch has been positively retracted inside the upper tool holder or cartridge 92. This assures that the punch has been completely stripped from the sheet even if the normal urethane stripper has not performed the task. Next, for complete safety the table advancement is completed before the punch extends below the lower face of the upper cartridge 92. To increase move distance the table advancement time can be extended to stop just before the punch 32 reaches the workpiece. In order for the table to have sufficient time to advance the sheet between punch cycles it is advantageous to have a large percentage of each crankshaft revolution associated with table movement. In a prior art punch press with a crankshaft such as shown in FIG. 9 only a small portion of crankshaft 42 rotation are allowed for table movement. This combined with the high crankshaft rotational speed does not allow sufficient time for table advancement for effective continuous nibbling. In the disclosed punch press 10 approximately 200 degrees of rotation of crankshaft 42 are allowed for table movement. This coupled with the lower crankshaft RPM permits adequate sheet advancement for continuous nibbling.

I claim:

1. A punch press comprising a punching head (30) including a driven crankshaft (42), an upper tool support (92) for supporting a plurality of punches (32), a lower tool support (94) for supporting dies (34) which are associated with the punches (32), an interposer (50) disposed between the crankshaft (42) and the punch (32) for reciprocating the punch (32) as the crankshaft (42) rotates, a clutch (46) for connecting the crankshaft to a drive when energized, a worksheet positioning system (20) for relative positioning of a workpiece (14) and the punching head (30), said press characterized by:

the eccentric of said crankshaft (42) causes the punch (32) to be fully withdrawn within the upper tool support (92) for more than 90 degrees of crankshaft (42) rotation.

2. A punch press comprising:

a punching head disposed above a punching area;

a positioning table for positioning a worksheet to be punched beneath said punching head;

a punch cartridge having a variety of punches disposed therein and being positionable to move a selected punch beneath the punching head;

a die cartridge movable with said punching cartridge to position an appropriate die, aligned with the selected punch, beneath the punching area;

connecting means for connecting a rotatable crankshaft, which forms part of said punching head, to a selected punch for punching the worksheet with said crankshaft having eccentricity so the punch is withdrawn into and movable within the punching cartridge for more than 177 degrees of crankshaft rotation.

3. A punch press as claimed in claim 2 wherein:

the speed of said crankshaft is no greater than 500 RPM.

4. A punch press as claimed in claim 2 wherein:

said connecting means comprises an interposer which makes a positive connection between said selected punch and said crankshaft.

5. A punch press comprising:

a punching head, including a driven crankshaft, disposed above a punching area;

worksheet positioning means for relative positioning of a worksheet at a desired location beneath said punching head;

punch support means for supporting a variety of punches therein and having a bottom from which a selected punch is exposed during operation and being positionable to move a selected punch beneath said punching head;

die support means for supporting and positioning a variety of dies associated with the punches;

connecting means for connecting said crankshaft to the selected punch for punching a workpiece; and, said crankshaft having a relatively large eccentricity so the selected punch is withdrawn and movable within said punch support means for more than 90 degrees of crankshaft rotation.

6. A punch press as claimed in claim 5 wherein:

said connecting means makes a positive connection between said crankshaft and the selected punch.

7. A punch press comprising:

a punching head including a rotatable crankshaft;

an upper tool holder supporting a plurality of punches and being movable to position a selected punch beneath said punching head;

a lower tool holder supporting a plurality of dies which are associated with the plurality of punches and being positioned with said upper tool holder to properly position a die beneath the selected punch;

connecting means for positive connecting said crankshaft to said selected punch to reciprocate said selected punch and withdraw said selected punch fully within said upper tool holder for more than 170 degrees of crankshaft rotation.

* * * * *